US009048520B1

(12) United States Patent
Burnham et al.

(10) Patent No.: US 9,048,520 B1
(45) Date of Patent: Jun. 2, 2015

(54) QUICK-RELEASE WAVEGUIDE FLANGE CLAMP

(71) Applicants: Timothy M. Burnham, Anchorage, AK (US); Alex Smith, Anchorage, AK (US)

(72) Inventors: Timothy M. Burnham, Anchorage, AK (US); Alex Smith, Anchorage, AK (US)

( * ) Notice: Subject to any disclaimer, the term of this patent is extended or adjusted under 35 U.S.C. 154(b) by 0 days.

(21) Appl. No.: 14/052,933

(22) Filed: Oct. 14, 2013

(51) Int. Cl.
*H01P 1/00* (2006.01)
*H01P 1/04* (2006.01)
*B25B 5/10* (2006.01)

(52) U.S. Cl.
CPC ..... *H01P 1/042* (2013.01); *B25B 5/103* (2013.01)

(58) Field of Classification Search
USPC ..... 333/253–255
See application file for complete search history.

(56) References Cited

U.S. PATENT DOCUMENTS

| | | | | |
|---|---|---|---|---|
| 4,541,934 | A | 9/1985 | Hakola | |
| 4,864,260 | A * | 9/1989 | Huard | 333/255 |
| 5,166,650 | A * | 11/1992 | Simmons et al. | 333/254 |
| 7,436,275 | B2 | 10/2008 | Dale | |
| 7,764,150 | B2 | 7/2010 | Dale | |

FOREIGN PATENT DOCUMENTS

| | | | |
|---|---|---|---|
| JP | 361065602 | * | 4/1986 |
| JP | 02012129894 | * | 7/2012 |

* cited by examiner

*Primary Examiner* — Dinh Le
(74) *Attorney, Agent, or Firm* — Michael J. Tavella

(57) ABSTRACT

A quick-release clamp that is placed over a pair of waveguide flanges and then locked into place. The device eliminates the need for laborious removal and reinstallation of numerous small nuts and bolts from the waveguide flanges, which are a time consuming component of every maintenance job done on the waveguides. The device consists of a formed clamp that conforms the to the shape and size of a particular waveguide flange pair. The clamp is hinged in one corner and has a securing mechanism in the opposite corner. The inside of the clamp has gaskets than ensure a tight secure fit for the clamp. In this way, a variety of waveguide flanges can be opened and sealed quickly and easily.

2 Claims, 8 Drawing Sheets

QUICK-RELEASE WAVEGUIDE FLANGE CLAMP

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to waveguide clamps and particularly to quick-release waveguide clamps.

2. Description of the Prior Art

Waveguides are commonly used for transmitting electromagnetic wave energy from one point to another. One of the more extensive commercial uses of waveguides is the transmission of electromagnetic signals from transmitting or receiving equipment. This transmission may occur, for example, between an equipment shelter and an antenna, often mounted on a tall tower. Waveguides generally consist of a hollow metallic tube of defined cross-section in the direction of propagation. Commercially available waveguides may be either of the rigid wall or flexible variety and their cross sectional shapes may be rectangular, circular and elliptical. Because waveguides are essentially tubes, they are typically connected by flanges that are bolted together with nuts and bolts. FIG. 1 shows a pair of waveguides 100 and their flanges 101 having been separated. As shown, several bolt holes 102 are shown in each flange. Usually, waveguides are also relatively small, making the connection hardware small as well. As a result, a technician working on waveguides often has to remove and install several small nuts and bolts in a typical workday. Several patents have been issued for waveguides to simplify their construction and assembly. But none of these patents address the issue of the bolted connection, which is an issue long after the waveguides are first assembled and installed.

BRIEF DESCRIPTION OF THE INVENTION

The instant invention overcomes these difficulties. It is a quick-release clamp that is placed over a pair of waveguide flanges and then locked into place. The device eliminates the need for laborious removal and reinstallation of numerous small nuts and bolts from the waveguide flanges, which are a time consuming component of every maintenance job done on the waveguides.

The device consists of a formed clamp that conforms the to the shape and size of a particular waveguide flange pair. The clamp is hinged in one corner and has a securing mechanism in the opposite corner. The inside of the clamp has gaskets than ensure a tight secure fit for the clamp. In this way, a variety of waveguide flanges can be opened and sealed quickly and easily.

DETAILED DESCRIPTION OF THE INVENTION

Figure 2:
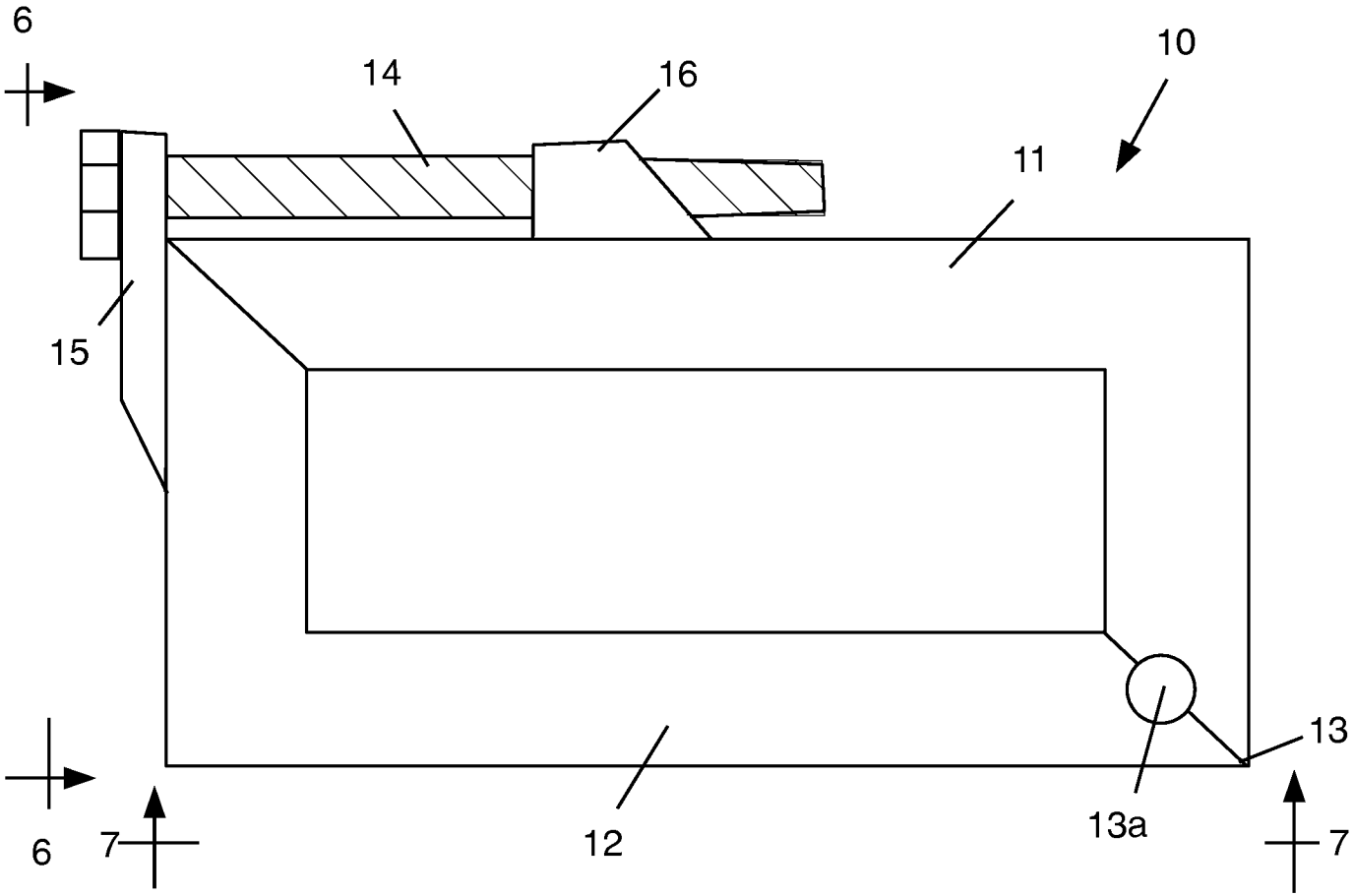
FIG. 2 is a front view of a first embodiment of the invention in the closed position.

Referring now to FIG. 2, a front view of a first embodiment of the invention in the closed position. In this view, the invention 10 is shown attached to waveguide flanges. (See FIG. 3). In the center of the clamp is the center of a waveguide 100 (note the term "waveguide" when used here includes standard wave guides, feed horns, and other fittings that are connected by bolt-type flanges). The clamp 10 is made up of two "L" shaped brackets 11 and 12 that are connected at a hinge 13 (see, e.g., FIG. 7) with hinge pin 13*a*. The clamp is secured, in this embodiment, by a bolt 14. The bolt is passed through a retainer flange 15 secured to bracket 12 and is threaded into a threaded receiver 16 that is secured to bracket 11. Alternatively, the receiver 16 can be a simple slotted tab fir use with a bolt, a nut and a lock washer. Either of these can be considered to be a means for locking the clamp in a closed position about a pair of waveguide flanges. Note that the threads in the receiver or the nut and lock washer can be considered as a means for tightening the bolt to the receiver to tightly close the clamp.

Figure 1:
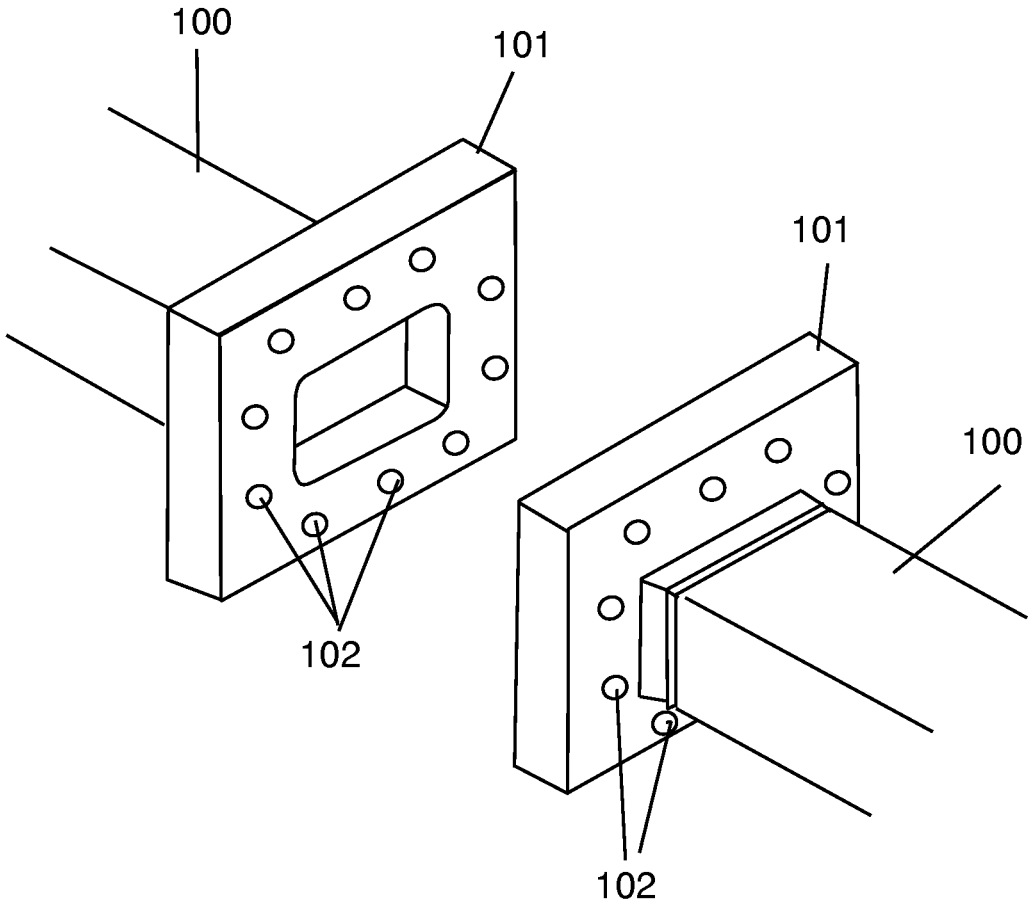
Figure 1 Prior Art
FIG. 1 is a perspective view of two waveguides showing their flanges separated as prior art.
Figure 3:
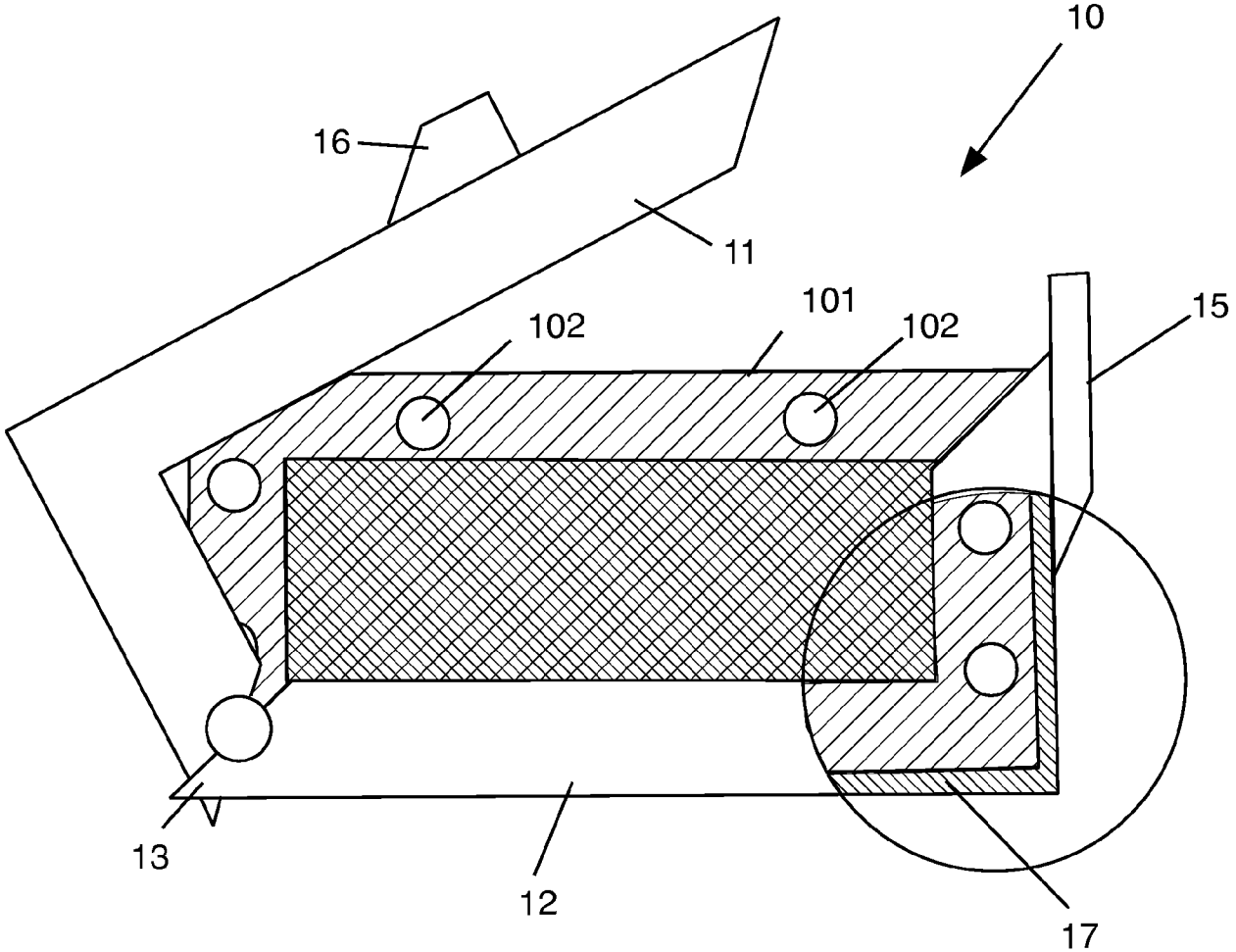
FIG. 3 is a rear view of the first embodiment shown open about a waveguide flange. This figure includes a partial cutaway view of the clamp.

FIG. 3 is a rear view of the first embodiment shown open about a waveguide flange. This figure includes a partial cutaway view of the clamp. Here, the waveguide flange 101 is shown with bolt holes 102. In use, the clamp is opened about hinge 13 and placed over two flanges 101 (see FIG. 4). Note that, as shown in the cutaway portion, the bolt holes 102 are completely covered when the clamp is in place (see also FIG. 1). Once the clamp is positioned, bracket 11 is brought down until it contacts bracket 12, as shown in FIG. 1. In this way, the clamp secures both flanges of the waveguides. The brackets 11 and 12 are sized such that when closed, the brackets just cover the bolt holes 102. Once bolt 14 is tightened, the clamp is secure over the flanges. Note too, that the cutaway shows a gasket 17 that fits around the flanges (see also FIG. 5).

Figure 4:
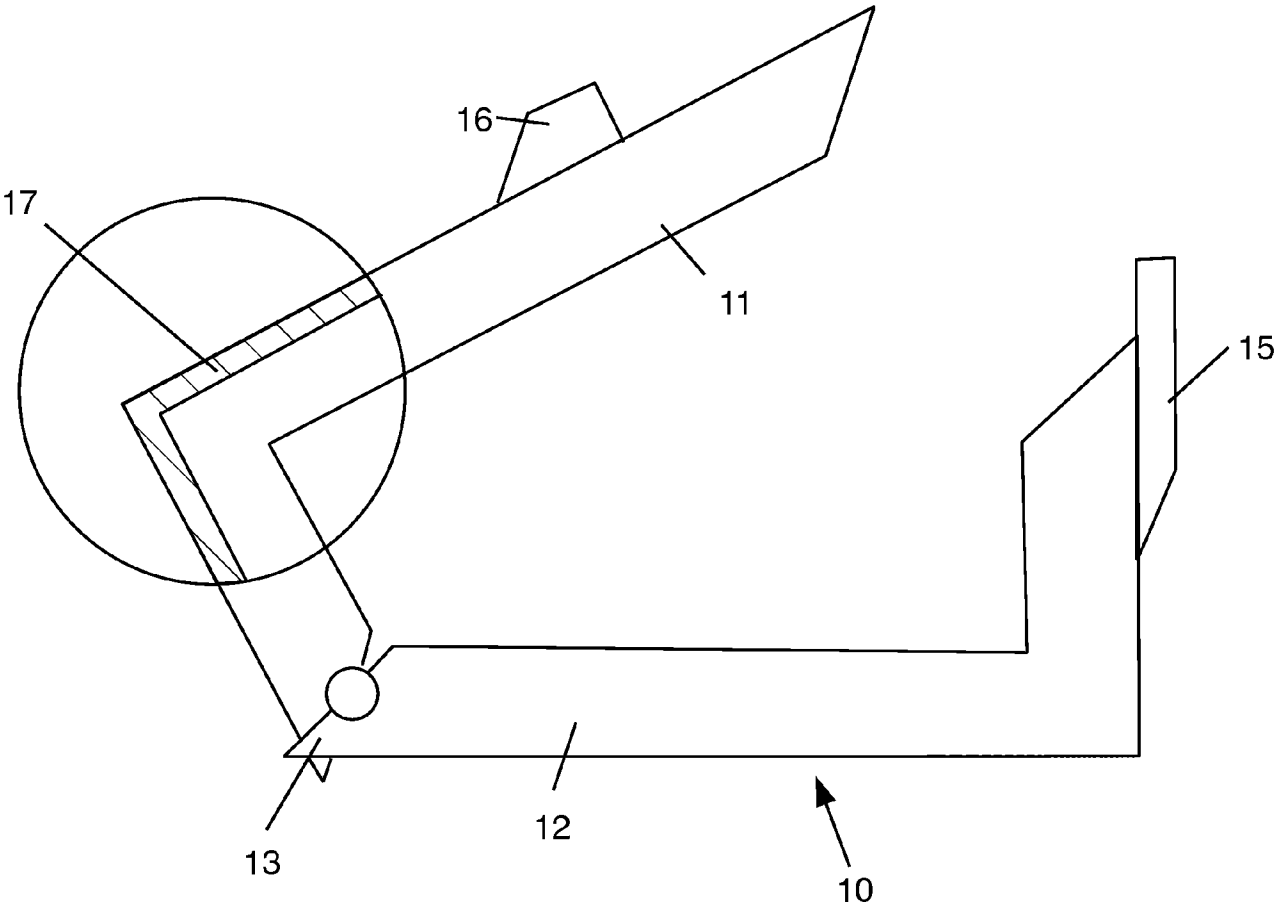
FIG. 4 is a rear view of the open clamp with an inset showing the internal gaskets as FIG. 5.
Figure 5:
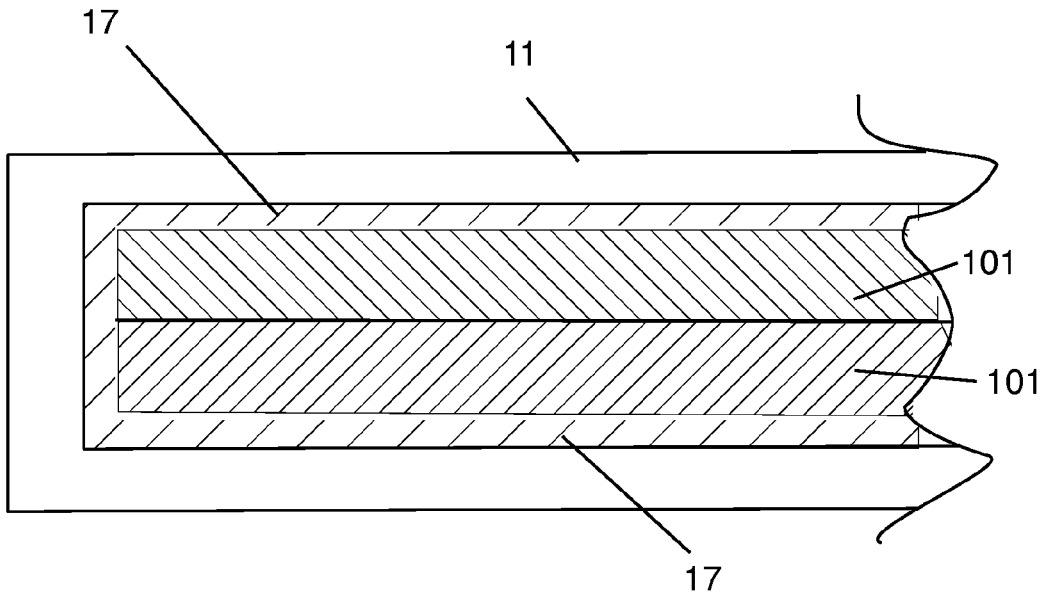
FIG. 5 is a detail view of the inside of the clamp of FIG. 4.

FIG. 4 is a rear view of the open clamp with an inset showing the internal gaskets as FIG. 5. Note that in the inset the gasket 17 is also shown.

FIG. 5 is a detail view of the inside of the clamp of FIG. 4 showing the waveguide flanges in place. In this view, an inside portion of bracket 11 is shown. The bracket 11 (and bracket 12) has a thickness to ensure a tight fit when the clamp is in place. As noted above, surrounding the flanges 101 on the inside of the bracket is a rubber gasket 17. A similar gasket is in place on bracket 12, but is not shown. The two waveguide flanges 101 are shown abutting in the clamp.

Figure 6:
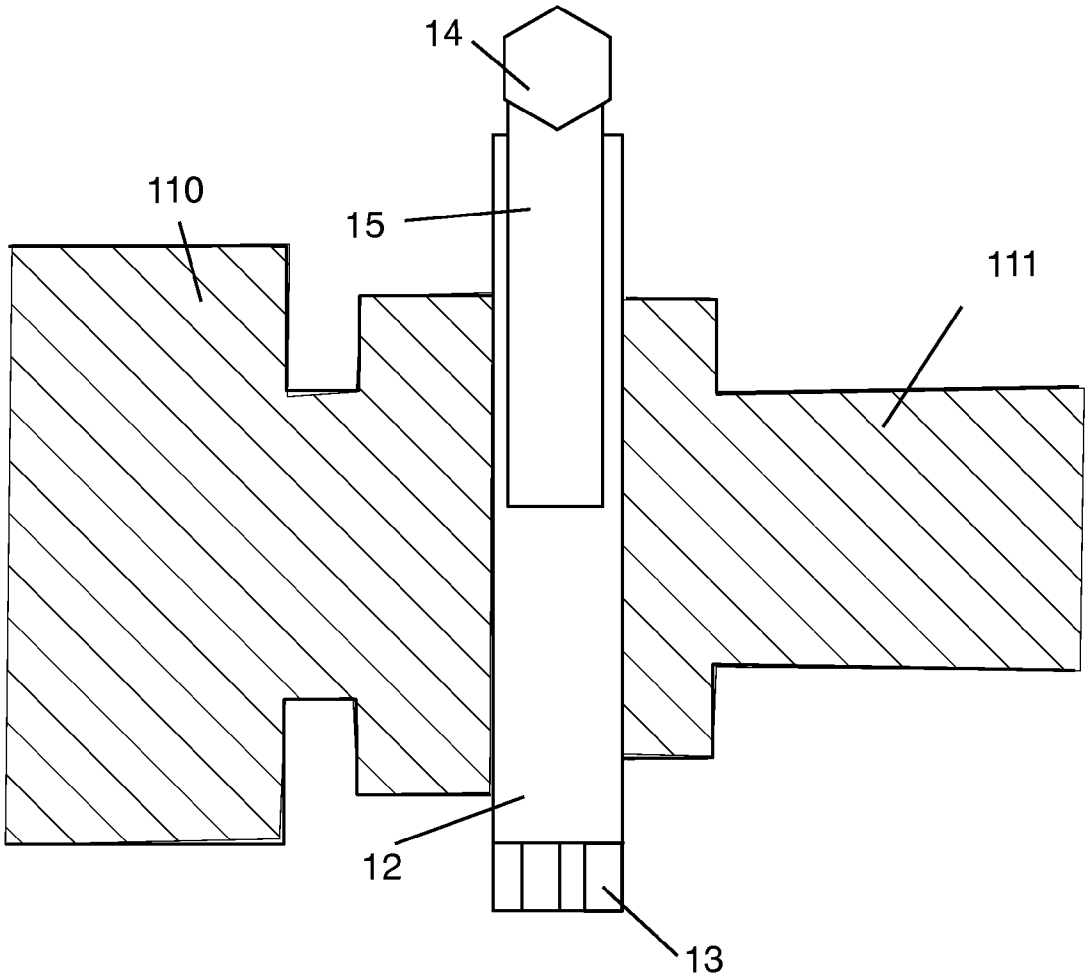
FIG. 6 is a left side view of the first embodiment in place on waveguide equipment taken along the lines 6-6 of FIG. 1.

FIG. 6 is a left side view of the first embodiment in place on waveguide equipment. Here, a first waveguide 110 is aligned with a second waveguide 111. The clamp 10 is in place securing the flanges. In this view, the bracket 12 is shown. The retainer flange 15 and bolt 14 are also shown. Note also that in this view, the hinge 13 is clearly shown.

Figure 7:
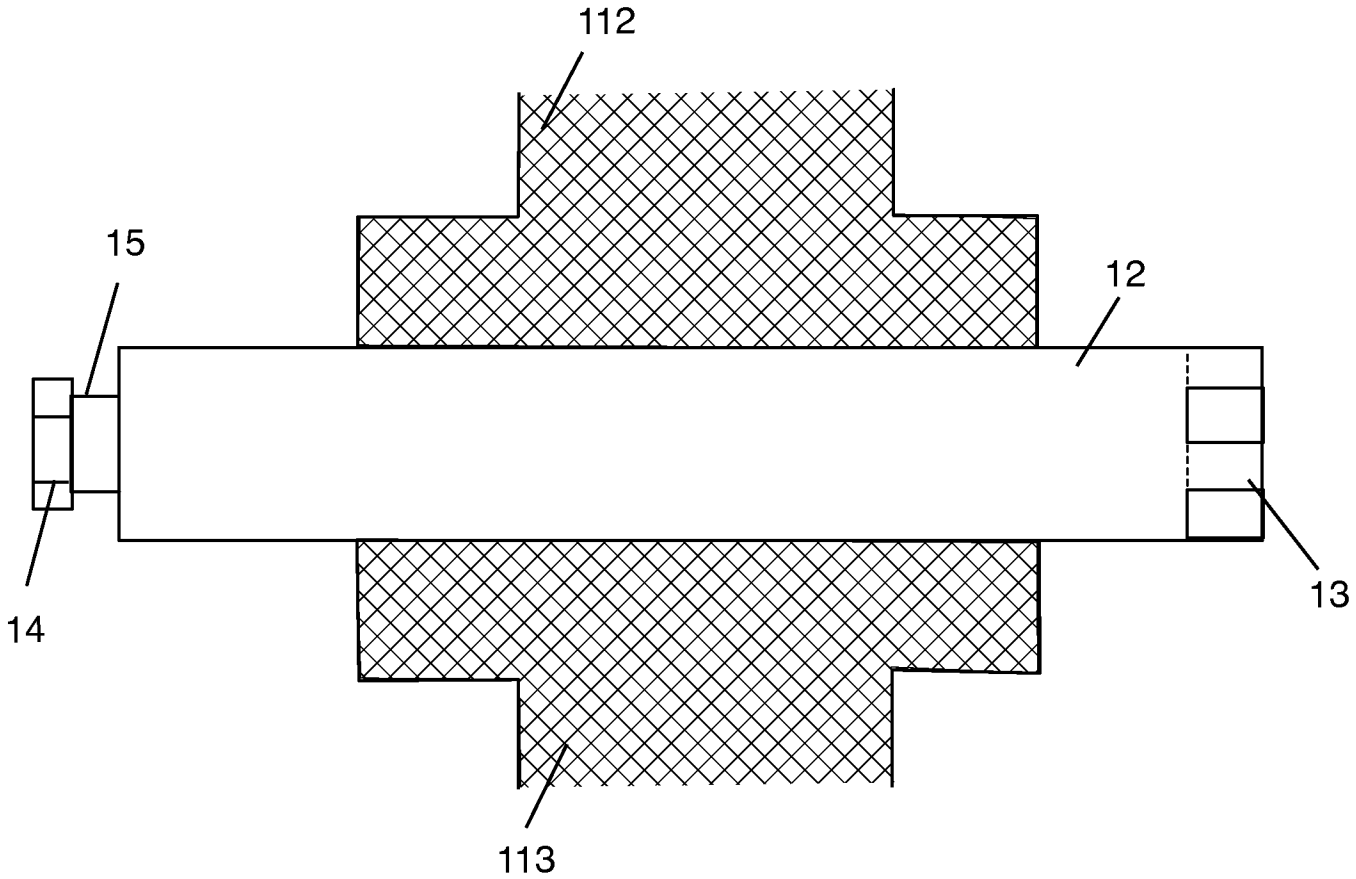
FIG. 7 is a bottom view of the first embodiment clamp in place on a pair of waveguides taken along the lines 7-7 of FIG. 1.

FIG. 7 is a bottom view of the first embodiment clamp 10 in place on a pair of waveguides 112 and 113. Here, the hinge 13, the bracket 12, the retainer 15 and the bolt 14 are all shown in place.

Figure 8:
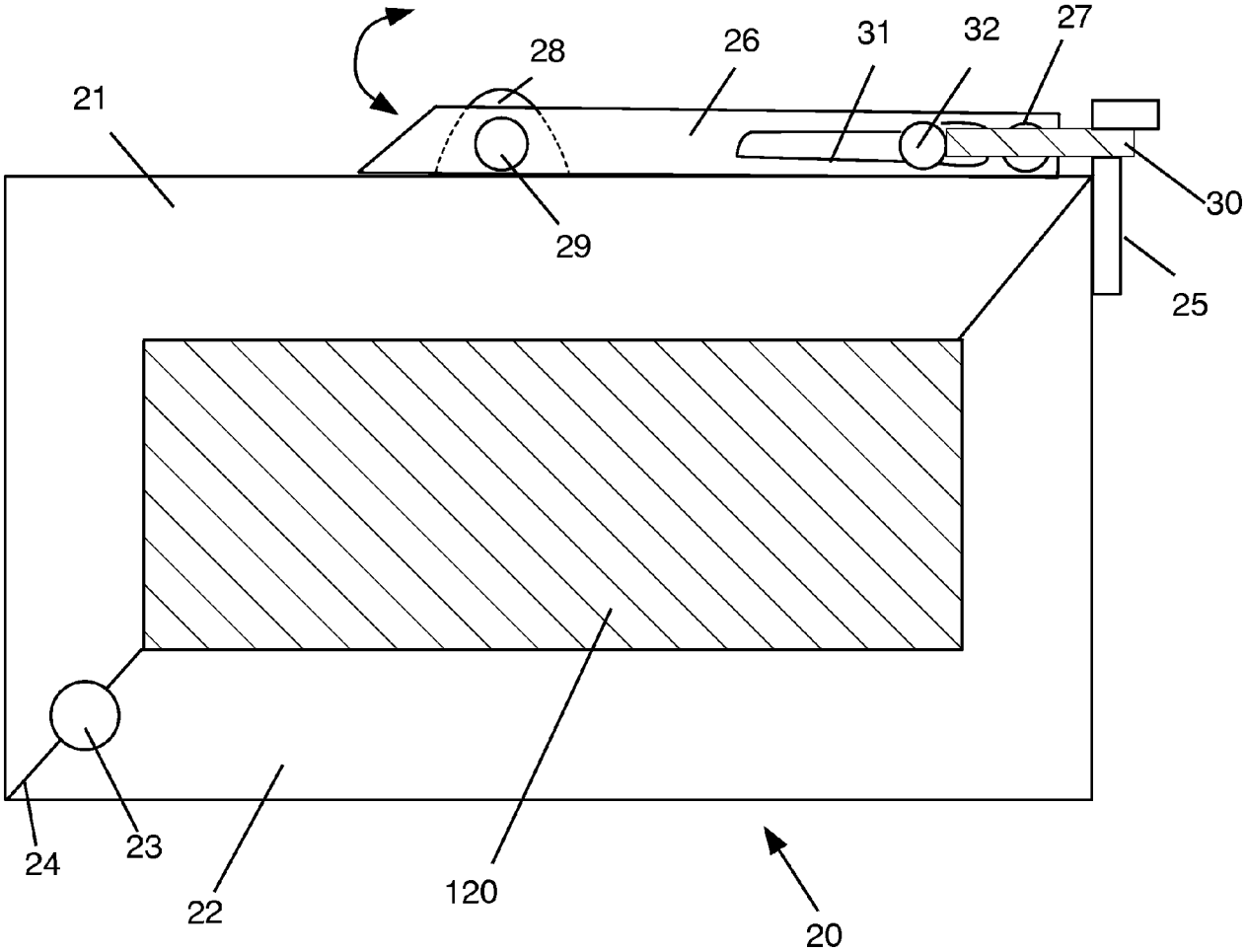
FIG. 8 is a front view of a second embodiment of the invention.

FIG. 8 is a front view of a second embodiment of the invention. In this figure, a waveguide 120 is clamped by clamp 20. It too has a top bracket 21 and a lower bracket 22 that are lined with gaskets (not shown) as before. A hinge pin 23 is placed in a hinge 24 as before. The difference in this embodiment is that the bolt has been replaced by a different locking system. In this embodiment, a lock tooth 25 is secured to bracket 22 as shown. A swing arm 26 in hinged to bracket 21 by a pin 27. A locking bracket 28 is attached to the top of bracket 21. It has a hole 28*a* that corresponds to the hole 29 in the swing arm 26. Thus, when the swing arm 26 is not locked in place, it is free to move up and down in an arc (as shown by the arrows). To keep the clamp closed and tight, a clasp 30 is secured in a slot 31 formed in the swing arm by a pin 32.

With the swing arm 26 raised, the clasp 30 is slid forward in the slot 31 until it passes over the top of the lock tooth 25. Then, the swing arm 26 is swung down until it is secure on the locking bracket 28, where it can be locked in place. In this way, the clasp pulls the clamp together to make a tight seal. This also can be considered to be a means for locking the clamp in a closed position on a pair of waveguide flanges.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A quick-release waveguide clamp comprising:

a) a first "L" shaped bracket, having a first end, a second end and an inner surface;

b) a second "L" shaped bracket also having a first end a second end and an inner surface;

c) a hinge, hingeably connecting said first ends of said first and second "L" shaped brackets, such that said first and second "L" shaped brackets having an open position and a closed position, and further wherein, when said first and second "L" shaped brackets are in said closed position they form a body conforming to the shape of a pair of waveguide flanges;

d) a lock tooth secured to said first "L" shaped bracket;

e) a swing arm, having a proximate end and a distal end, hingeably attached to said second "L" shaped bracket at said proximate end, said swing arm having a slot formed in said proximate end and having a locking hole formed in said distal end;

f) a locking bracket, having a locking hole formed therein, attached to said second "L" shaped bracket, positioned such that the locking hole in said locking bracket is aligned with the locking hole in said swing arm when said quick-release waveguide clamp is in a locked position; and g) a clasp secured in the slot said swing arm, said clasp having an open center portion such that when said swing arm is in an open position, said clasp is positioned over said lock tooth and further wherein when said swing arm is in a locked position, said clasp pulls the end of said first "L" shaped flange tightly against the end of said second "L" shaped flange, thereby sealing said pair of waveguide flanges.

2. The quick-release waveguide clamp of claim 1 further comprising: gaskets placed about the inner surface of said first and second "L" shaped brackets.

* * * * *